US006361289B1

(12) United States Patent
Hennes et al.

(10) Patent No.: US 6,361,289 B1
(45) Date of Patent: Mar. 26, 2002

(54) MEDICAL GEAR PUMP FOR SUCTIONING AND RINSING

(75) Inventors: Rolf Hennes; Pavel Novak, both of Schaffhausen; Beat Krattiger, Beringen; Joachim Willner, Hallau; Paul Farner, Thayngen; Hugo Rudolf Lampert, Diessenhofen; Martin Wittwer, Schaffhausen, all of (CH); Jürgen Kraft-Kivikoski, Radolfzell (DE)

(73) Assignee: Storz Endoskop GmbH (CH)

( * ) Notice: Subject to any disclaimer, the term of this patent is extended or adjusted under 35 U.S.C. 154(b) by 0 days.

(21) Appl. No.: 09/242,392

(22) PCT Filed: Jun. 15, 1998

(86) PCT No.: PCT/EP98/03601

§ 371 Date: Nov. 24, 1999

§ 102(e) Date: Nov. 24, 1999

(87) PCT Pub. No.: WO98/58174

PCT Pub. Date: Dec. 23, 1998

(30) Foreign Application Priority Data

Jun. 16, 1997 (DE) ..... 197 25 462

(51) Int. Cl.[7] ..... F04B 49/00; F01C 1/16

(52) U.S. Cl. ..... 417/310; 418/201.3

(58) Field of Search ..... 417/310, 307, 417/279, 137, 115; 418/201.1, 201.3

(56) References Cited

U.S. PATENT DOCUMENTS

| | | | | |
|---|---|---|---|---|
| 2,462,924 A | | 3/1949 | Ungar | |
| 3,870,437 A | * | 3/1975 | Gondek | 417/310 |
| 3,890,068 A | * | 6/1975 | Davidson | 418/132 |
| 4,065,235 A | * | 12/1977 | Furlong et al. | 417/420 |
| 4,078,653 A | * | 3/1978 | Suter | 418/201.1 |
| 4,371,324 A | * | 2/1983 | Gustafsson | 418/201.1 |
| 4,583,924 A | | 4/1986 | Zenglein et al. | |
| 5,108,275 A | * | 4/1992 | Sager | 418/201.3 |
| 5,163,824 A | | 11/1992 | Kantner | |
| 5,609,474 A | * | 3/1997 | Ohno | 417/288 |
| 6,129,535 A | * | 10/2000 | Becher | 418/201.3 |

FOREIGN PATENT DOCUMENTS

| | | | |
|---|---|---|---|
| DE | 18 21 554 | | 11/1960 |
| DE | 18 22 807 | | 12/1960 |
| DE | 19 75 041 | | 12/1967 |
| DE | 83 31 598 | | 4/1985 |
| DE | 39 43 369 | A1 | 7/1991 |
| DE | 197 25 462 | A1 | 12/1998 |
| EP | 0 692 265 | A2 | 1/1996 |
| FR | 2505642 | * | 5/1982 |
| WO | WO 96/01950 | | 1/1996 |

* cited by examiner

*Primary Examiner*—Charles G. Freay
(74) *Attorney, Agent, or Firm*—St. Onge Steward Johnston & Reens LLC

(57) ABSTRACT

A medical gear pump is used for suction and irrigation, in particular for endoscopy or the laboratory, and it has two meshing gears as conveying elements, one of which is joined to a drive mechanism. The gears are received in non-journal-mounted fashion in openings, and are each equipped with a helical tooth set. It is proposed to configure the helical tooth set such that, when viewed along a surface line of said gears, at least two tooth tip/root contact points of said meshing gears are present, and a contour of tooth spaces of the one gear is matched to the teeth of the other gear in such a way that when a tooth has completely penetrated into the tooth space, its tooth tip almost completely fills up the tooth space radially inside the pitch circle.

30 Claims, 9 Drawing Sheets

MEDICAL GEAR PUMP FOR SUCTIONING AND RINSING

CROSSREFERENCE OF PENDING APPLICATION

This application is 371 of pending international application PCT/EP98/03601 filed on Jun. 15, 1998.

BACKGROUND OF THE INVENTION

1. Field of the Invention

The present invention relates to a medical gear pump for suction and irrigation, in particular for endoscopy or the laboratory, comprising two meshing gears as conveying elements, one of which is joined to a drive mechanism, the gears being received in cylindrical openings of a pump housing and the openings being connected to an inlet and to an outlet, the gears being received in non-journal-mounted fashion in the openings and the two gears each being equipped with a helical tooth set.

2. Related Prior Art

A gear pump of this kind for homogenizing medical, cosmetic, and technical products and mixtures is known from German Utility Model No. 18 22 807.

It is possible for gears mounted in non-journal-mounted fashion to seal themselves with respect to the housing wall during operation as a result of the differential pressure of the pump.

In German Utility Model No. 18 22 807, coupling of the doubly ball-bearing-mounted drive shaft to the directly drive gear is accomplished by way of an oval stem end that is inserted into an oval bore in the driven gear. This primarily serves the purpose of better emulsification, since the eccentric freedom of movement of the directly driven gear with respect to the drive shaft is one-dimensional and co-rotates. Consistent sealing, over the entire rotation, of the tooth tips in the cylindrical bore in which the gears are received is thereby prevented, since because of its eccentricity, the directly driven gear is lifted to some extent out of its self-sealing position twice during each rotation. To ensure smooth operation, a mounting system for the pump drive shaft that is impact-damped using rubber rings is therefore provided.

A similar bearing system for the driven shaft is known from German Utility Model No. 18 21 554.

A gear pump of this kind for delivering highly aggressive media is known from German Utility Model No. 19 75 041.

It is known from DE 83 31 598 U1 to additionally provide irrigation conduits.

When a pump of this kind is used in the medical field, the actual conveying means, i.e. the gears and the corresponding flow conduits, come into contact with the medical liquids, thus posing the problem of cleaning and disinfection.

The pumps that have become established in the medical field are therefore primarily peristaltic ones, in which the medical liquids are transported by rollers which act externally on flexible tubes.

Although it is possible thereby to ensure that the actual conveying elements do not come into direct contact with the medical liquid, the resulting conveyed flow is nevertheless a pulsating flow, which is not especially suitable, in particular, for applications in hysteroscopy, urology, and arthroscopy.

It is therefore the object of the present invention to create a medical pump which on the one hand is of simple design and also easy to clean, and moreover supplies a continuously variable controllable conveyed flow with high pump efficiency.

SUMMARY OF THE INVENTION

According to the present invention, the object is achieved in that in the case of the gear pump cited initially, the helical tooth set of the gears is configured such that, when viewed along a surface line of the gears, at least two tooth tip/root contact points of the meshing gears are present; and the contour of the tooth spaces of the one gear is matched to the teeth of the other gear in such a way that when a tooth has completely penetrated into the tooth space, its tooth tip almost completely fills up the tooth space radially inside the pitch circle.

The fact that at least two tooth tip/root contact points of the meshing gears are present along a surface line ensures precise concentricity of the meshing gears without wedging forces. The driven gear is in meshing engagement, continuously and in exact alignment, with the undriven non-journal-mounted gear. This eliminates the risk that the undriven gear will come into contact with edges or corners of the overlapping cylindrical housing bores. Coordination of the contours of the tooth spaces and teeth, in such a way that a tooth that has penetrated completely into the tooth space almost completely fills up the latter, on the one hand ensures that only an extremely small cavity volume, i.e. almost no volume at all, is present between the tooth space and tooth and is filled with liquid, and thus only extremely small quantities of liquid can be transported back at all, so that pump output efficiency is maintained at high rotation speeds. If greater quantities were transported back at high rotation speeds, pump output efficiency would be greatly reduced. In addition, this configuration creates outstanding sealing between the delivery and intake sides of the pump.

As a result of the helical tooth set in conjunction with the two-point contact and the particular configuration of the tooth and tooth space, the flow conduit which is necessarily present between the meshing teeth is sealed in such a way that any out-flow through it is efficiently prevented.

It is possible with this special configuration, in the case of meshing gears having a helical tooth set, to dispense with a central journal bearing arrangement for the two gears. The axial bearing points in the conveying chambers which receive the gears are accordingly also omitted. The result is not only to eliminate numerous niches for bacteria, which are difficult to clean and disinfect, but assembly and disassembly are also very simple, since for assembly the gears simply need to be placed into the conveying chamber, with no need to ensure that pivot bearing journals are inserted into a specific bearing point. The special helical tooth set not only results in very quiet-running gears, so that the operator is not disturbed by loud pump noises, but leads to consistently exact meshing engagement with the drive gear. The two gears are received, with a slight radial clearance, in approximately cylindrical overlapping openings. The diameter of the cylindrical openings is thus slightly greater than the diameter of the addendum circle of the respective gears. When the pump according to the invention is then operated with the non-journal-mounted gears, the relative overpressure on the delivery side causes the undriven gear to be displaced somewhat toward the intake side. In other words, during operation, the gears move slightly out of coaxial alignment in the approximately cylindrical chamber in which the respective gear is received. The result of this, when considering the addendum circle of the undriven gear, is an approximately half-sickle-shaped region, widening toward the delivery side, between the addendum circle and the circular inner wall of the conveying chamber in which that gear is received.

This region on the one hand ensures that transfer of the conveyed liquid of a tooth space from the intake pressure state to the outlet pressure is accomplished extremely smoothly, especially in conjunction with the helical tooth set and the configuration of the teeth, resulting not only in extremely quiet conveying but also in a transition from the tooth space to the pressure level with no loss of pressure. The combination of sickle and helical tooth set yields particularly harmonious, smooth, and thus also quiet conveying.

Because of the sickle-shaped region opening toward the delivery side, a force component is created which pushes the undriven gear toward the driven gear. This movement of the meshing gears toward one another results, in combination with the particular configuration of the teeth, in outstanding sealing between these gears, so that a self-sealing effect can be achieved. Backflow from the teeth as they come out of engagement, which impairs pump efficiency, is thereby greatly minimized. This is because the meshing teeth come out of engagement in a direction opposite to the inlet; i.e. quantities of liquid caught between the tooth space and tooth would be conveyed against the conveying direction, which can greatly impair pump output efficiency.

In production engineering terms, this has the considerable advantage that there is no need to produce highly precise parts to tight tolerances, but rather that a relatively wide tolerance range is available so that economical production methods are possible. This also opens up the possibility, for example, of manufacturing the gears from plastic materials, and optionally providing them for one-time use.

The good sealing attained by way of the working principle of the invention, and less by way of high precision in parts production, also results in a correlation between the pressure/flow characteristics diagram, the torque/speed characteristics field, and the current/voltage characteristics diagram that is more reproducible than with usual gear pumps. This allows these characteristics diagrams to be determined once on one production unit; these matrix values can then be used for pressure and flow control, eliminating direct outlet pressure measurement (which is associated with a certain complexity).

In a further embodiment of the invention, a pump body is provided which is detachably joined to a drive body, the inlet, cylindrical openings with gears, and outlet being arranged in the pump body.

This feature has the considerable advantage that for cleaning and disinfection, the pump body is removed from the drive body and the components which come into contact with medical liquids, i.e. the inlet, conveying chambers, gears, and outlet, are present in one and the same component, namely in the pump body, which can then be correspondingly cleaned and disinfected.

In a further embodiment of the invention, the pump body is configured so that it can be placed onto the drive body.

This feature has the advantage that handling during disassembly and assembly is particularly simple, i.e. for example, after being used the pump body simply needs to be removed from the drive body, which is very easy and can be performed by even untrained persons.

In a further embodiment of the invention, the pump body is joinable to the drive body via a bayonet coupling.

This feature has the advantage that a bayonet coupling is very easy to close and open, and at the same time ensures the appropriate sealing contact pressure between pump body and drive body.

In a further embodiment of the invention, the pump housing is configured as a solid plastic part in which the cylindrical openings are recessed in such a way that the gears can be inserted into the cylindrical openings from one side of the pump housing.

This feature has the considerable advantage not only that the pump housing can be manufactured as an economical part, for example an injection-molded part, but also that installation of the gears in the pump housing is very easy: they simply need to be pushed in or out once the pump cover has been pulled off. The plastic part can be manufactured as a mass-produced item, so that it can be configured as a disposable part, i.e. the pump body is discarded after a single use, and a new pump body is simply placed onto the drive body.

In a further embodiment of the invention, there projects from the driven gear a coupling stem which is insertable into a corresponding coupling counterelement of a motor in the drive body.

This feature has the advantage that the nonpositive connection between the drive mechanism and the driven gear can be created very easily by way of the push-in coupling.

In a further embodiment of the invention, an intermediate pin is arranged between the coupling stem and motor.

This feature has the advantage that the gear, with its drive stem, can be easily removed and replaced by removing the pump cover, for example via a bayonet coupling. Because of its replaceability, the intermediate pin with its double-articulated effect also has the advantage that different coupling diameters can be used for single-use and multiple-use pump versions. This makes it possible to injection-mold the drive stem along with the gear as a unit for the single-use version, and for the multiple-use versions to anchor into the driven gear a stainless, hardened, and sufficiently strong steel stem with a small outside diameter. A small outside stem diameter results in a lower circumferential speed at the corresponding sealing lip, and this in turn results in less wear on the stem seal.

In a further embodiment of the invention, the coupling between the coupling stem and motor is configured as a slot coupling.

This feature has the advantage that the coupling is self-aligning, i.e. regardless of the relative rotational position of the coupling stem and coupling counterelement, alignment is accomplished and any shaft offset is compensated for.

Thus by simply placing the pump body onto the drive body, the coupling between motor and driven gear can simultaneously also be aligned and closed.

In a further embodiment of the invention, a stoppage sealing valve is arranged in the outlet.

This feature has the advantage that when the pump is stopped, no backflow can occur in either direction. If the pump is being used, for example, as an irrigation pump, it is usually conveying from a reservoir vessel located higher up, so that it is then possible to ensure in particular that no backflow or over-flow can occur through the pump.

In a further embodiment of the invention, the stoppage sealing valve is configured as a ball-type nonreturn valve.

This feature has the advantage that the outlet can be blocked to prevent backflow or outflow during a stoppage using only a few components, for example a spring-loaded ball, components which can easily be assembled, disassembled, and cleaned.

In a further embodiment of the invention, the stoppage sealing valve is configured as a slit body made of flexible material that is arranged in the cross section of the outlet.

A passive stoppage sealing valve of this kind can be configured, for example, by way of a simple cross-slit silicone disk. The outside diameter of the slit disk corresponds to the outside diameter of a pump outlet tube. The diameter of the peripheral circle of the crossed slits in the disk corresponds to the inside diameter of the pump outlet tube. The disk is simply held immovably between the end surface of the pump outlet tube introduced into the housing outlet bore and the inner stop surface of the housing outlet bore. The differential pressure for the transition from stoppage sealing to flow can be adjusted by way of the disk thickness and/or the Shore hardness of the silicone disk.

In a further embodiment of the invention, the stoppage sealing valve is configured as a magnetically driven plunger, connected in parallel with a motor of the drive mechanism, which can be extended in blocking fashion into the cross section of the outlet when the motor switches off.

The advantage of this function is that an active stoppage shut-off valve is created. A flat plunger, not belonging externally to the replaceable pump body, acts, through a matching slot of the pump housing in the region of the housing outlet bore, on a relatively thin-walled silicone tube introduced there. In one linear end position of the plunger the flow is sealedly shut off; in the other linear end position the full flow is possible without a pressure loss. The housing slot and the nonrotatable plunger edge are configured so that regardless of the linear stroke position of the edge, the pump body can unimpededly be put in place or removed with a quarter-turn in bayonet fashion. The outside diameter of the thin-walled tube is somewhat larger than the diameter of the housing outlet bore. It is inserted via vacuum finger, and thereafter is sealed without adhesive bonding in all operating states of the housing bore.

In a further embodiment of the invention, an overpressure valve is provided which, in the event of overpressure, moves a pump cover relative to the pump housing in such a way that even though the drive mechanism is running, what occurs is not conveyance but rather backflow to the inlet.

This feature has the advantage that overpressure situations can be regulated with relative simple measures. In an overpressure situation, the pump cover is moved so as to create an opening from the outlet toward the inlet, so that the pump conveys back toward the inlet in circulating fashion.

In a further embodiment of the invention, an overpressure valve spring with plunger is provided in the drive body, and in an overpressure situation allows the pump cover to tilt away from the pump housing on one side.

These features are particularly easy to manufacture in terms of production engineering, for example by way of corresponding molded-on elements if the pump cover is configured as a plastic part. In an overpressure situation the pump cover can then tilt slightly to the side, for example via a molded-on tilting edge, so that the seal of the conveying chamber between inlet and outlet is broken and the pump conveys from the inlet through the resulting opening back toward the inlet. When the overpressure situation no longer exists, the plunger pushes the pump cover back again and the seal once again exists, so that the pump then conveys from the intake side to the delivery side.

In a further embodiment of the invention, there is received in the drive body a pressure sensor which communicates with the outlet via a membrane and a stub line.

This feature has the advantage that the components which may be mechanically somewhat more complex, such as the pressure sensor, can be received in the drive body in a manner hermetically sealed off with respect to the pump body, and thus do not need to be disassembled, cleaned, and sterilized after use. Technically complex pressure monitoring and overpressure control systems can thus also be provided without impairing the simple configuration of the actual pump body, with the advantages described previously.

In a further embodiment of the invention, the helical tooth set is configured as a herringbone tooth set.

This feature has the advantage that the herringbone tooth set can create a particularly intensive engagement at multiple points on the meshing gears, and the herringbone arrangement makes possible particularly good sealing between the gears and compensates for axial forces.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

The invention will be explained and described in more detail below with reference to preferred embodiments in conjunction with the accompanying drawings, in which.

DETAILED DESCRIPTION OF PREFERRED EMBODIMENTS

A gear pump shown in FIGS. 1 through 10 is designated in its entirety with the reference number 10.

Pump 10 comprises two essential constituents, namely a pump body 12 and a drive body 14.

Figure 1:
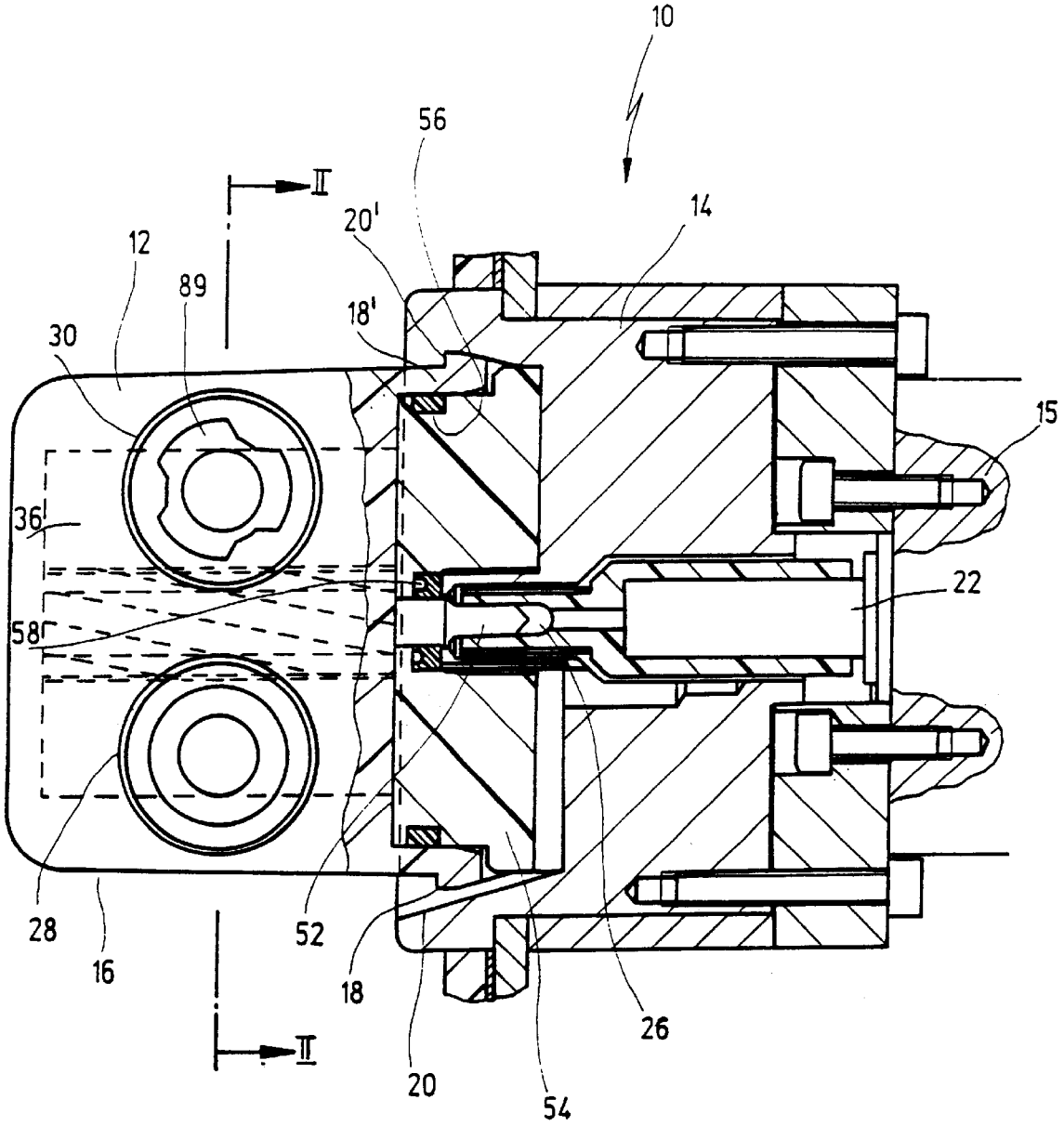
FIG. 1 shows a longitudinal section of a medical gear pump that is mounted on a motor.

FIG. 1 shows that drive body 14 of pump 10 is joined to a motor 15.

Pump body 12 substantially comprises a pump housing 16, a pump cover 54 closing off the latter on one side, and gears 42 and 44 received in the pump housing. Projecting from pump housing 16, on its side facing drive body 14, are bayonet flanges 18, 18' and a bayonet stop 21.

Bayonet flanges 18, 18' serve to engage into corresponding bayonet guides 20, 20' on drive body 14.

Pump body 12 can thus be joined via a bayonet coupling to drive body 14.

Figure 9:
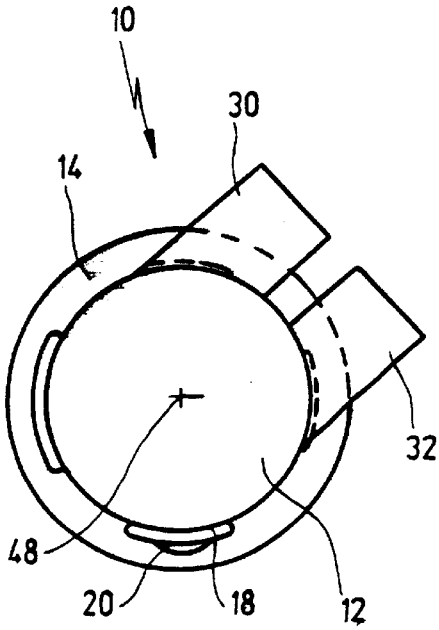
FIG. 9 shows a plan view of the pump during an assembly step after a pump body has been placed onto a drive body and before a bayonet guide has been closed.
Figure 10:
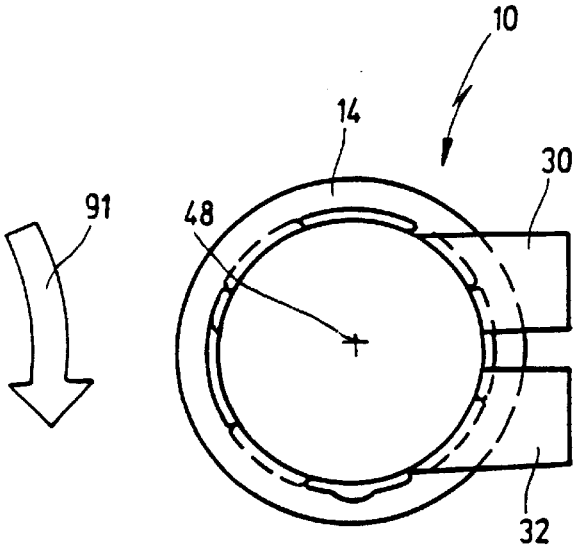
FIG. 10 shows a plan view of the pump after the bayonet closure has been closed.

This operation is shown in the sequence of FIGS. 9 and 10.

It is evident from the plan view of FIG. 9 that the approximately cylindrical pump body 12 can be placed on drive body 14, which has a slightly greater diameter, in such a way that bayonet flanges 18 are axially inserted into bayonet guides 20.

The bayonet coupling is then closed by rotation (clockwise in the exemplifying embodiment shown) approximately 45 degrees along arrow 91; the final assembled state is shown in FIG. 10, and corresponds to the section shown in FIG. 1.

The simple, quick 45-degree bayonet assembly and disassembly process of the complete pump body 12 also allows for rapid emergency decoupling or deactivation of pump 10 in this fashion, without spilling liquid or negatively affecting the user or the device.

As is evident from FIG. 1, motor shaft 22, which is joined on the side facing pump body 12 to a slot coupling 26, is received centeredly in drive body 14.

Projecting from the approximately cylindrical pump housing 16, as is evident in particular from FIG. 1 and FIGS. 8 through 10, are two tubular fittings 28 and 30 running parallel to one another.

Tubular fitting 28 and its centeredly continuous cylindrical bore serve as inlet 32, which opens into a chamber 34.

Chamber 34 is configured as a centered gap 36, open toward the bottom side of pump body 12 that faces drive body 14.

Provided centeredly in gap 36 are two cylindrical openings 38 and 40, also opening toward the bottom side, which serve to receive gears 42 and 44. A center point 48 of cylindrical opening 38 in which gear 42 is received also corresponds to the center point of the approximately cylindrical pump housing 16 and of pump cover 54, as is evident from FIGS. 9 and 10.

At the end located opposite inlet 32, gap 36 opens into an outlet 46 which is configured as a centered continuous bore through tubular fitting 30.

Gear 42 is equipped with a pivot stem which protrudes axially at one end of gear 42 and is configured there as coupling stem 50. One end of coupling stem 50 is flattened and pointed to define an intermediate pin 52. The pivot stem and gear 42 can be of one-piece or two-piece configuration.

As is evident in particular from the sectioned representation of FIG. 1, pump housing 16 comprises a pump cover 54 which is sealed with respect to pump housing 16 via an outer sealing ring 56. A further seal 58 surrounds coupling stem 50 of gear 42 which extends through pump cover 54.

Coupling stem 50 and thus gear 42 is guided sealingly but rotatably by pump cover 54. Intermediate pin 52 engages into a slot coupling 26 of output shaft 22 of motor 15, thus creating a nonpositive connection. Gear 42 is therefore the driven gear. The other gear 44 is also non-journal-mounted. Both gears are guided in floating fashion in cylindrical openings 38 and 40.

Figure 4:
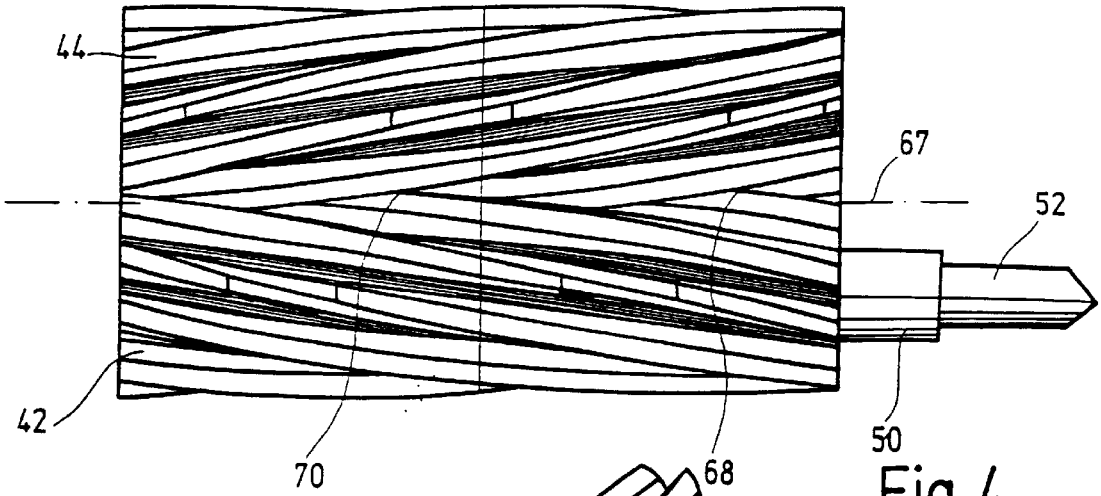
FIG. 4 shows a side view of the two meshing gears.
Figure 5:
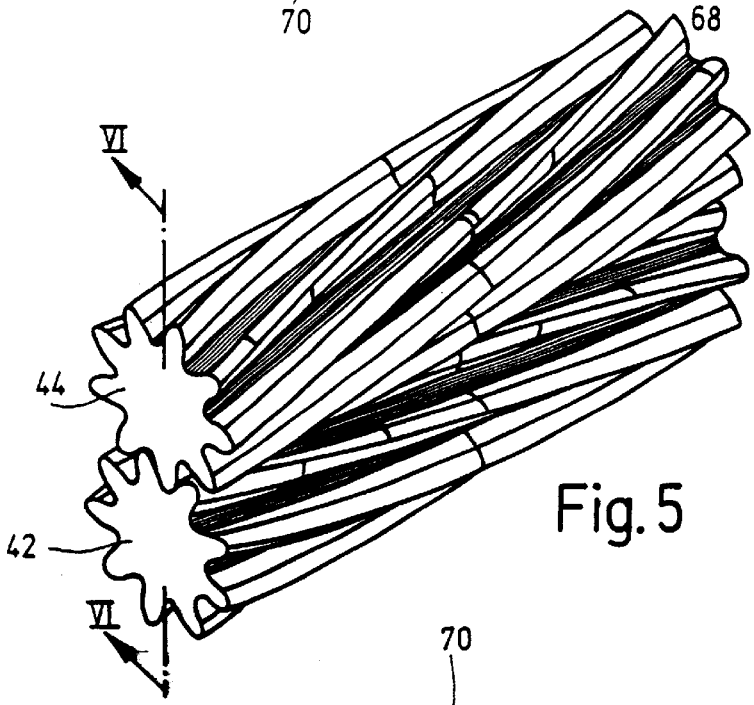
FIG. 5 shows a perspective oblique view of the two meshing gears.
Figure 6:
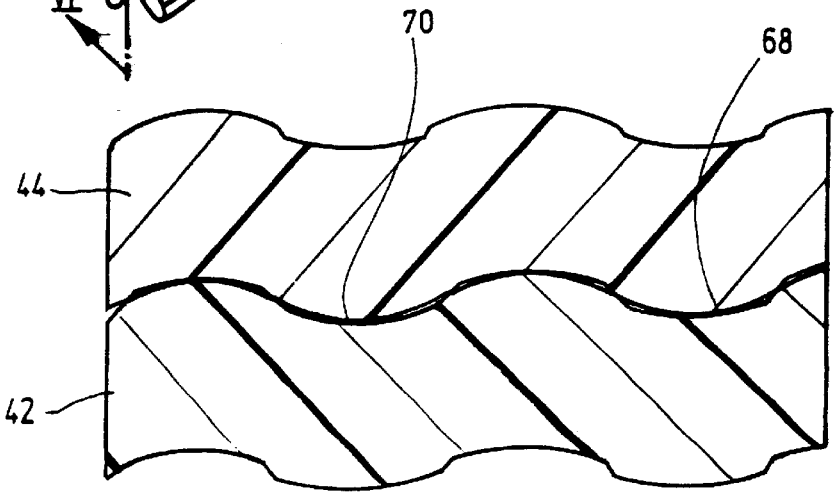
FIG. 6 shows a section along line VI—VI in FIG. 5.

It is evident from the representations of FIGS. 4 through 6 that the meshing gears 42 and 44 are each equipped with a helical tooth set.

It is evident from FIGS. 4 and 6 that, when viewed along a surface line 67, at least two tooth tip/root contact points 68 and 70 are present. In other words, at least two successive tooth/gap pairs are in meshing engagement along a surface line. This makes possible exact guidance of the non-journal-mounted gear 44 via driven gear 42.

Figure 7:
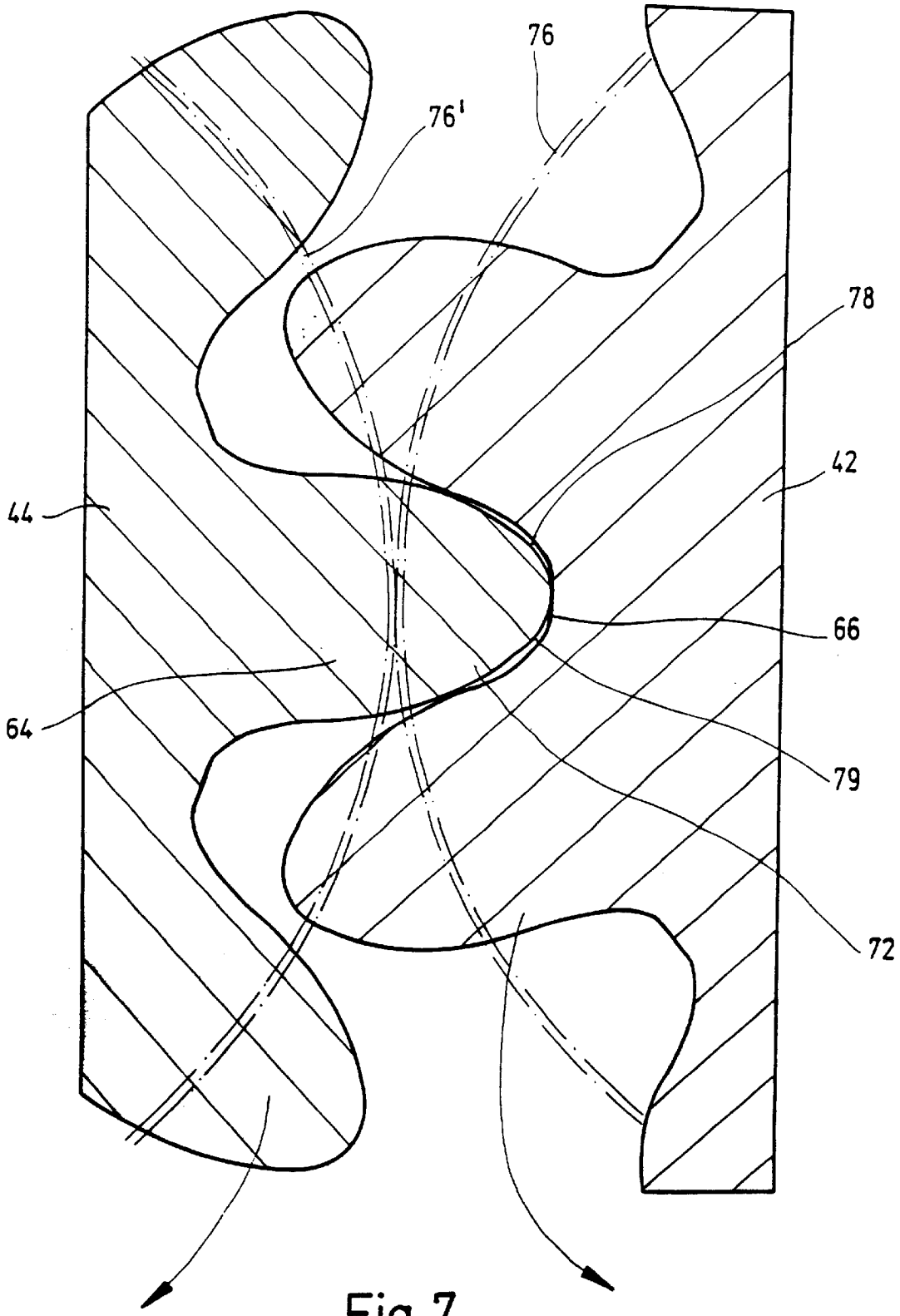
FIG. 7 shows a greatly enlarged partial cross-sectional representation of the two meshing gears.
Figure 8:
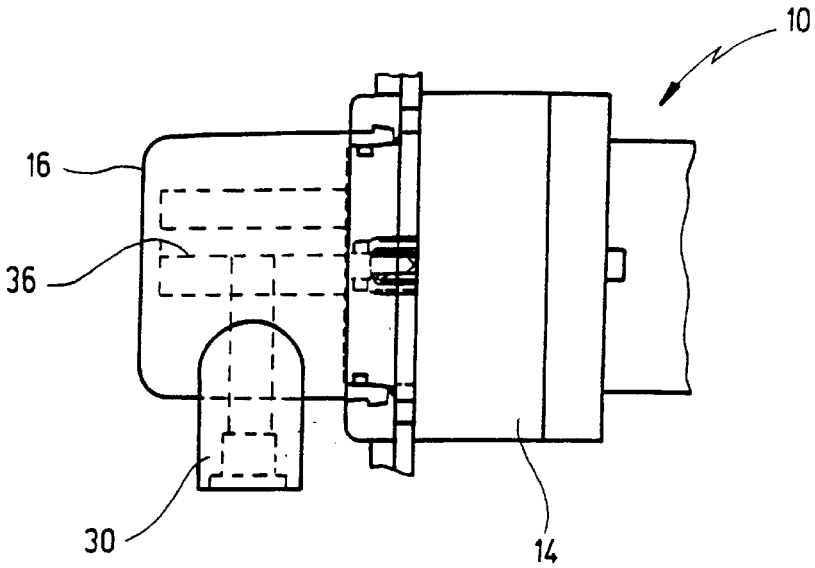
FIG. 8 shows a side view of the pump in a state rotated 90 degrees as compared with the sectioned representation of FIG. 1.

It is evident from the sectioned representation of FIG. 7 that the cross-sectional profile of a tooth 64 is such that tooth 64, when it has penetrated completely into a having a tooth root 67, almost completely fills it up in the region of its tooth tip 72, specifically in the region radially inside pitch circle 76. The configuration of the tooth flanks is such that upon meshing, a tip/root contact with nonpositive engagement but without wedging effect is achieved. The remaining open spaces 78 and 79 are very small, just sufficient to allow rolling-contact motion. It is also evident from the sectioned representation of FIG. 7 that only insignificant quantities of liquid can thus be received in spaces 78 and 79.

Figure 3:
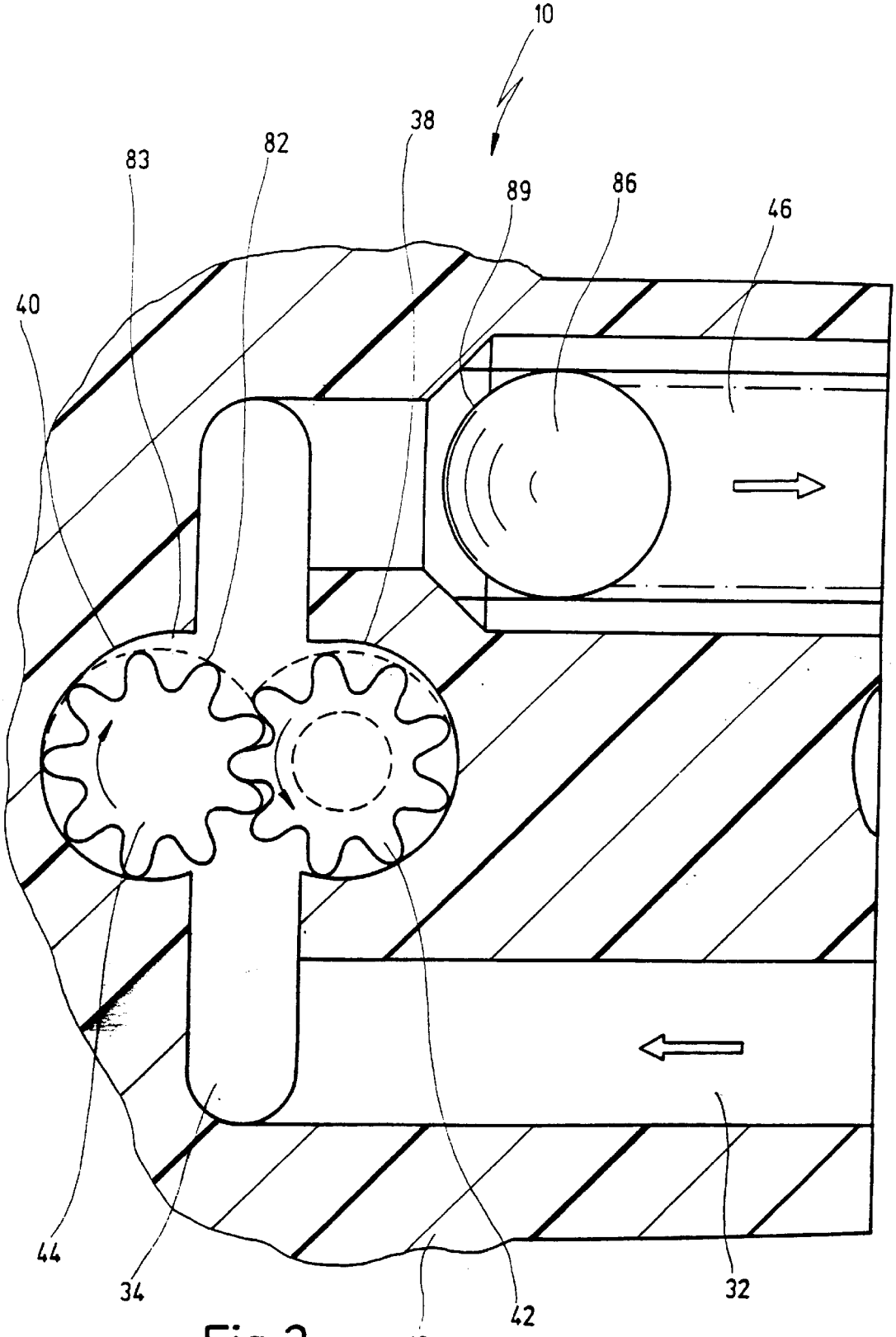
FIG. 3 shows a partial and greatly enlarged view of the central region of the section in FIG. 2.

It is evident from the sectioned representation of FIG. 3 that the undriven gear 44 rotates clockwise, and the driven gear 42 counterclockwise.

As indicated by an arrow, liquid coming from inlet 32 is conveyed via the radial outer side of gears 42 and 44 toward outlet 46.

It is apparent from the enlarged sectional representation of FIG. 7 that only extremely small quantities of liquid can be conveyed at all back toward the inlet, so that backflow is negligibly low, thus considerably increasing efficiency and thus capacity. The leakage cross section is in fact approximately 1% of the conveying cross section of a tooth space.

It is also evident from the enlarged representation of FIG. 3 that during operation, because of tolerances the non-journal-mounted gears 44 and 42 move slightly in the direction of the inlet, specifically because of the pressure difference between inlet 32 and outlet 46. If addendum circle 82 of gear 44 as shown in FIG. 3 by a dashed line is now considered, it is evident that a sickle-shaped region 83, widening on the delivery side toward outlet 46, has been created in the region of the upper (in the representation of FIG. 3) half between the inner side of cylindrical opening 40 and addendum circle 82. This results in force components which press the two gears 44, 42 toward one another, so that the effect shown in FIG. 6 is even further enhanced.

Figure 2:
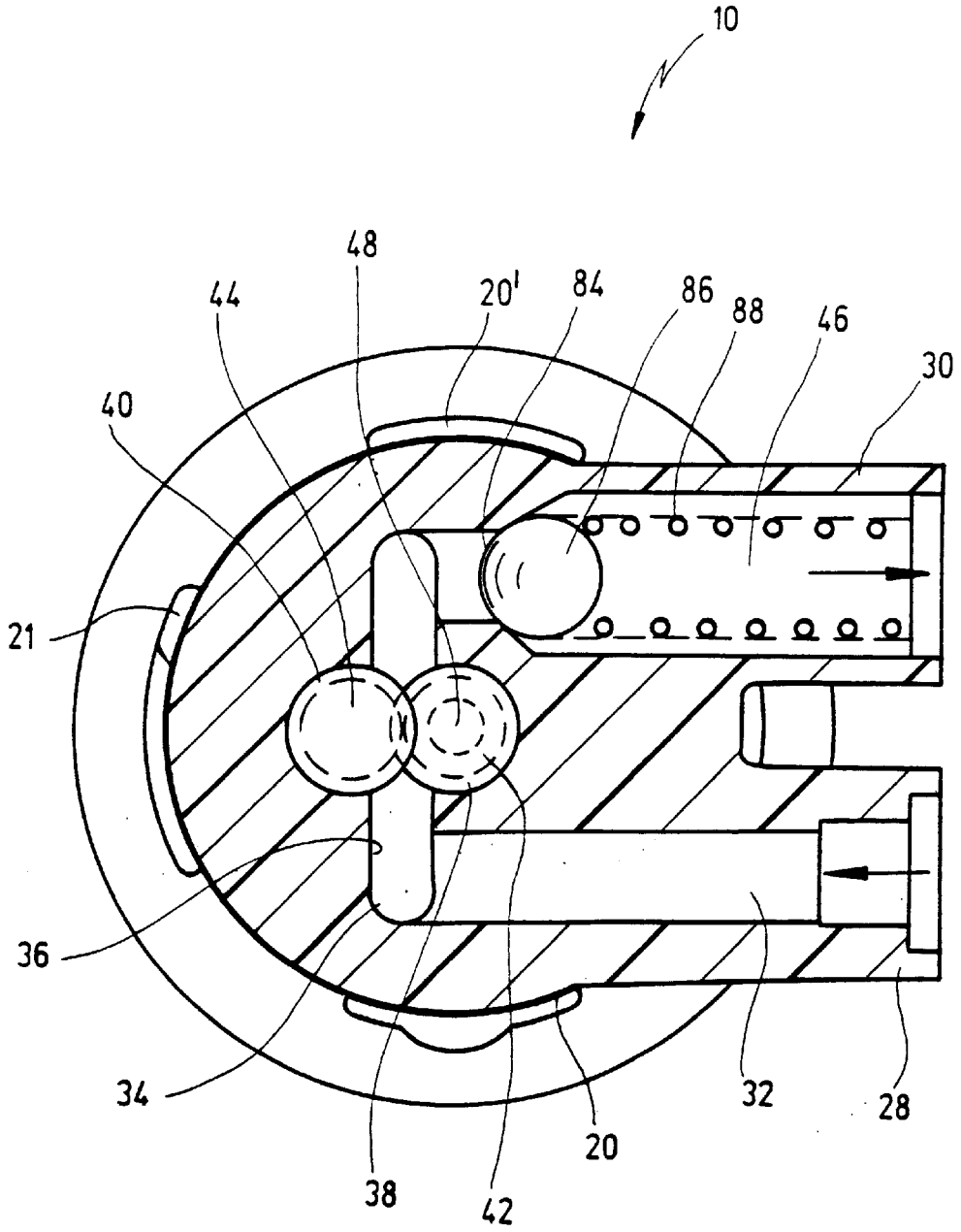
FIG. 2 shows a section along line II—II in FIG. 1.

As is evident in particular from the representations of FIG. 2 and FIG. 3, a stoppage sealing valve 84 is arranged in outlet 46.

Stoppage sealing valve 84 comprises a ball-type non-return valve having a ball 86, acted upon by the force of a spring 88, that is pressed by spring 88 onto a valve seat 89. The force of spring 88 is adjusted so that during operation, ball 86 lifts off from valve seat 89, so that liquid can be conveyed through outlet 46. In a backflow and stoppage situation, ball 86 is pressed against valve seat 89 and seals outlet 46, so no conveyed volume can flow back or out through pump 10.

After pump 10 has been used, pump housing 16 can be rotated in accordance with the sequence of FIG. 10 to FIG. 9, thus undoing the bayonet coupling, and pump housing 16 can be removed from drive body 14. In the process, coupling stem 50 automatically detaches from slot coupling 26 of motor shaft 22 of motor 15. Once pump housing 16 has been removed and after pump cover 54 has been pulled out, gears 42 and 44 can be taken out of the housing through the open side, and the individual parts can be cleaned and then sterilized; the simple geometrical configuration of slot 36 and inlet 32 and outlet 46 favors these actions.

After sterilization, all that is necessary is to push gears 42 and 44 back into cylindrical openings 38 and 40, insert pump cover 54, and place pump body 12 back onto drive body 14 as shown in FIG. 9, and close the bayonet coupling.

In an embodiment, provision is made for both gears 42 and 44 to be embodied as plastic gears, thus as single-use disposable parts, so that only the actual pump housing 16 and cover 54 need to be cleaned and sterilized.

In a further embodiment, pump housing 16 and pump cover 54 are also configured as disposable parts, so that no sterilization or cleaning operations at all needs to be performed after use.

Figure 11:
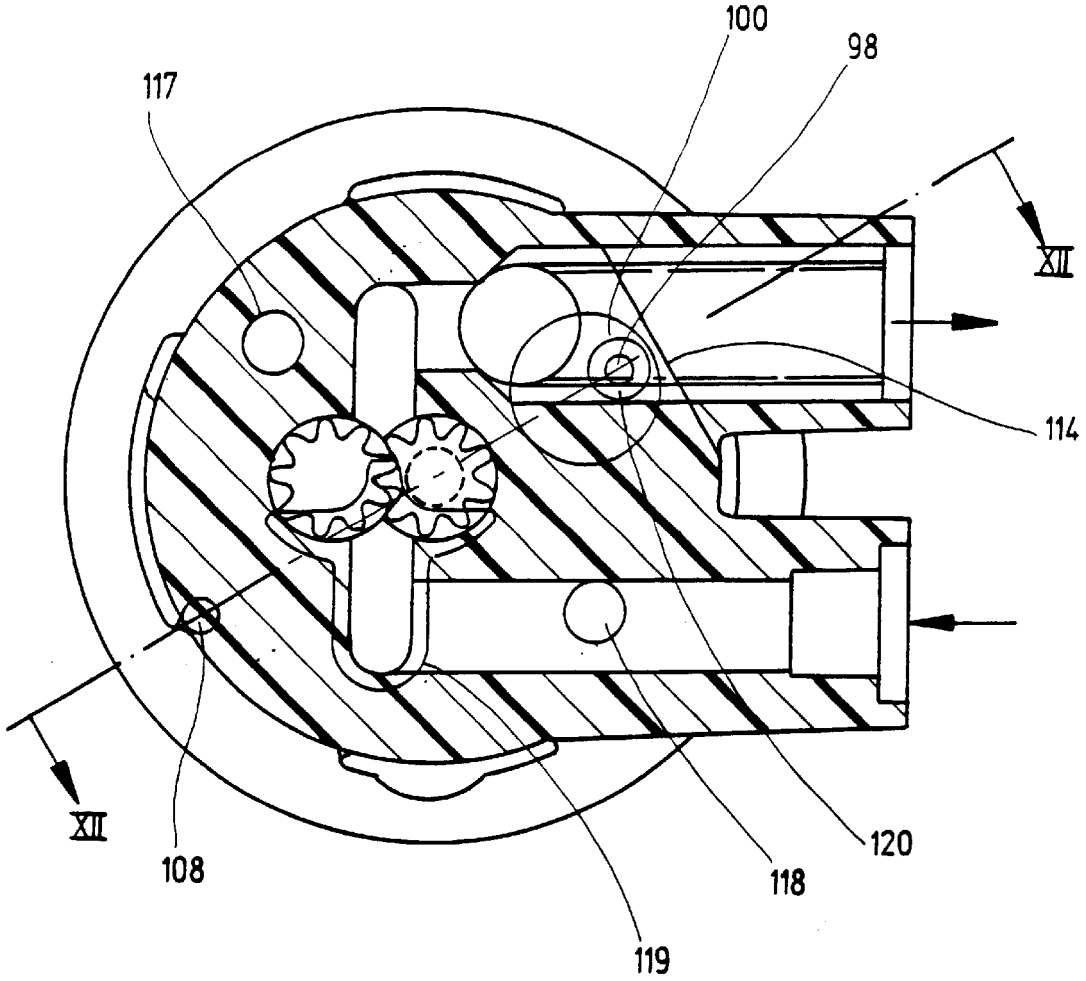
FIG. 11 shows a representation, comparable to the sectioned representation of FIG. 2, of a further exemplary embodiment with an overpressure valve embodiment.
Figure 13:
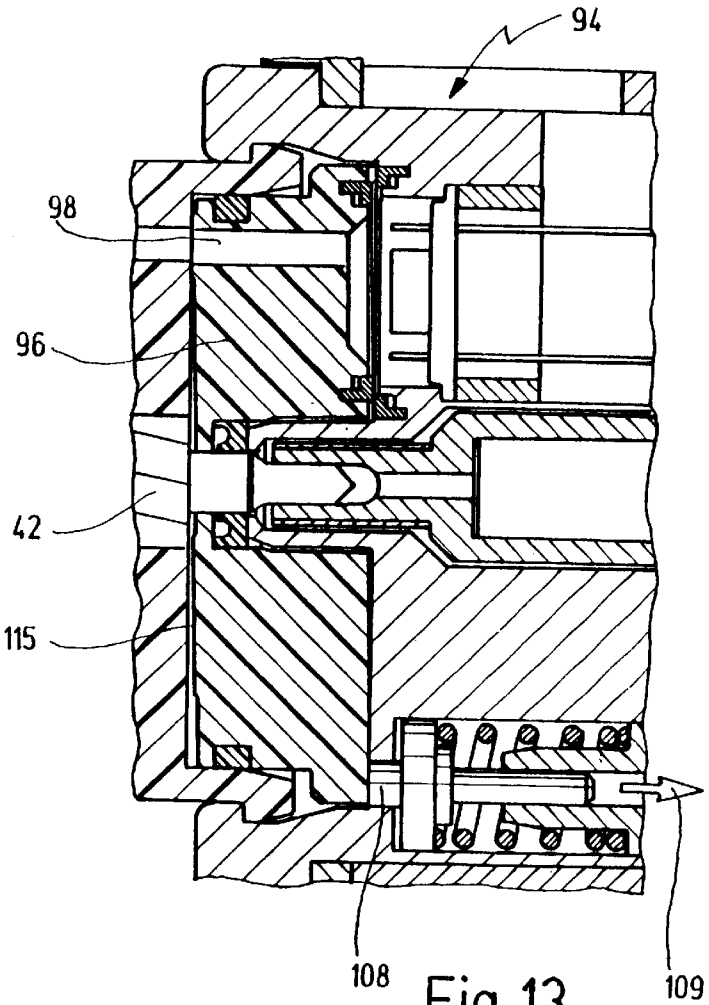
FIG. 13 shows a partial representation of the section of FIG. 12 in an overpressure situation.
Figure 12:
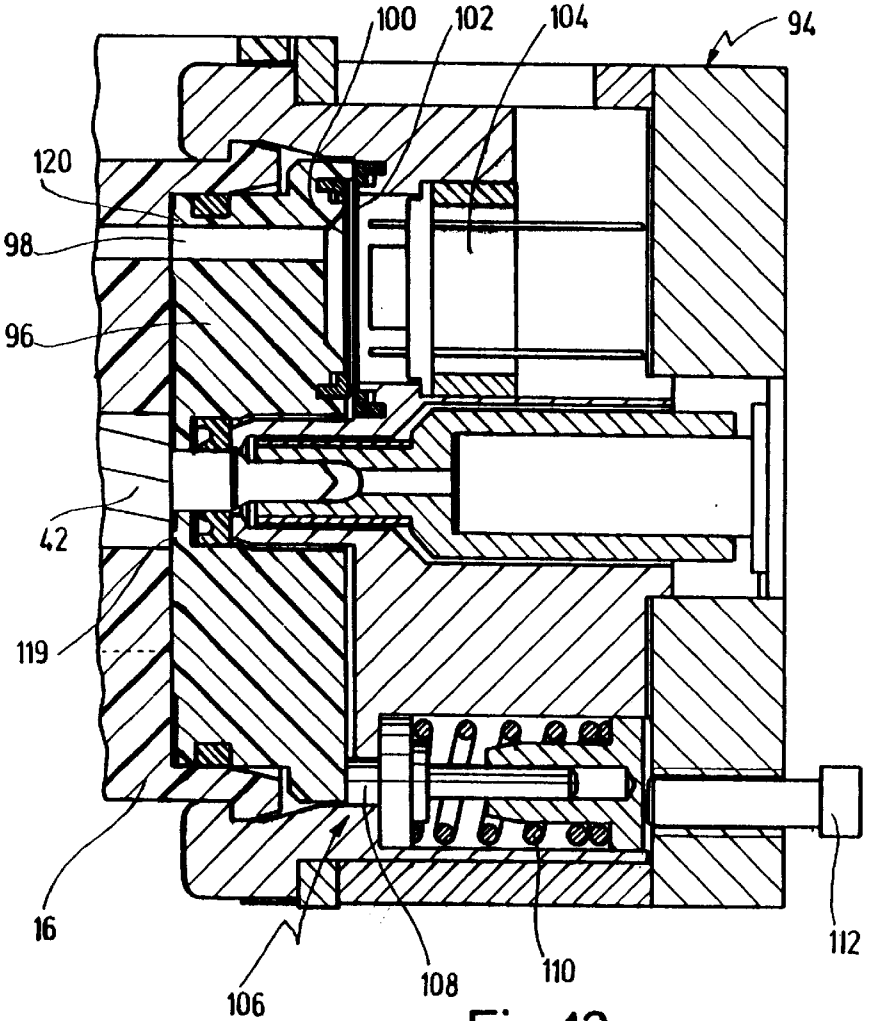
FIG. 12 shows a partial section, comparable to the representation of FIG. 1, along line XII—XII in FIG. 11, showing essentially the section through the drive body.

FIGS. 11 through 13 depict a variant of pump 10 in which an overpressure valve arrangement 106 is provided in drive body 94.

A stub line 98 leads through cover 96 from the outlet of pump housing 16. Stub line 98 stands on a membrane arrangement of two membranes 100, 102.

Membrane 102 is a constituent of a pressure sensor 104.

Pressure sensor 104 thus senses the pressure present in the outlet, and can thus detect an overpressure situation.

Pressure sensor 104 is coupled to overpressure valve 106.

Overpressure valve 106 has a plunger 108 that acts, via a spring 110 on a side diametrically opposite stub line 98, on cover 96, as also indicated in FIG. 11.

The pressure limitation can be adjusted via an adjusting screw 112. As is evident from the representation of FIG. 11, cover 96 can be tilted, via a tilting edge 114, slightly away from the underside of the pump housing and toward drive body 94, as is evident from the image sequence from FIG. 12 to FIG. 13.

FIG. 12 shows the normal situation, i.e. spring 110 presses cover 96, via plunger 108, against the open side of pump housing 16.

As is evident from FIG. 11, sealing surfaces 117, 118, 119, and 120, which represent a sufficient seal between the delivery and intake sides, are provided. The remaining surface is recessed approximately 0.5 mm, and is acted upon by outlet pressure.

In an overpressure situation, cover 96 tilts about tilting edge 114 and thereby presses plunger 108 against the force of spring 110, as shown in FIG. 13 by an arrow 109.

A connection is thus created between inlet and outlet, so that the pump then conveys from the inlet via gap 115 back toward the inlet.

Figure 14:
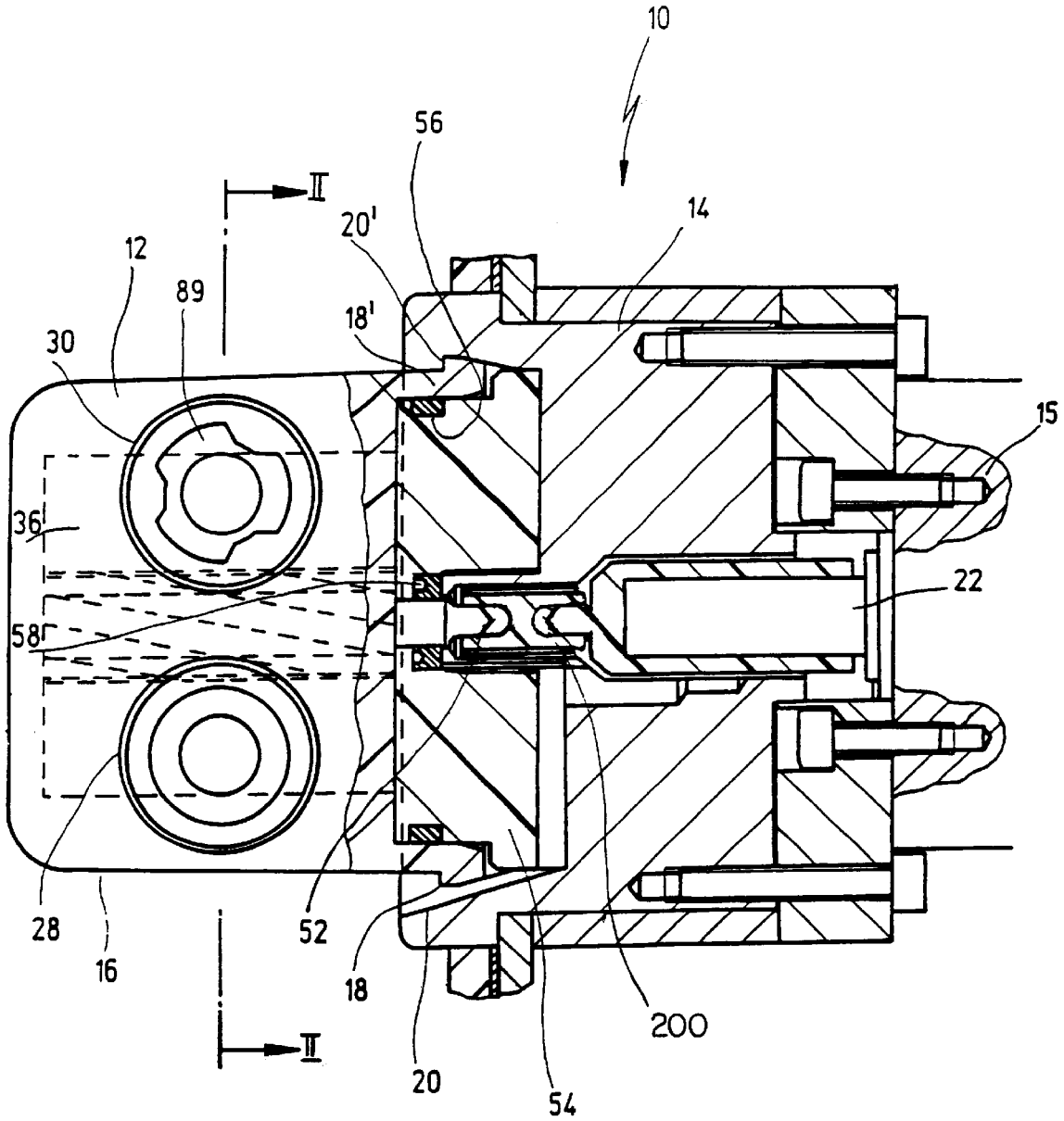
FIG. 14 shows a partial section, comparable to the representation of FIG. 1, of a further exemplary embodiment with an intermediate pin between the coupling stem and motor.

FIG. 14 depicts another variant pf pump 10 in which an intermediate pin 200 is arranged between the coupling stem 50 and motor 15.

Therefore, what is claimed, is:

1. A medical gear pump for suction and irrigation comprising:

a pump housing having an inlet and an outlet and two cylindrical openings therebetween;

two meshing gears as conveying elements, one of which gears is joined to a drive mechanism, said gears being received in a non-journal-mounted fashion in the cylindrical openings of said pump housing, each of said gears comprising a plurality of helical teeth, each tooth having a tooth tip and a tooth root and forming a single continuous helix;

wherein the teeth of each of said gears mesh to define a helical tooth set which, when viewed along a surface line of said gears, defines at least two tooth tip/root contact points of said meshing gears, and wherein when a tooth of a first of said gears has completely penetrated into a tooth space of a second of said gears, its tooth tip substantially completely fills up said tooth space radially inside a pitch circle of the second of said gears; and wherein said pump housing and said gears define a path for liquid flow from the inlet, radially about the gears between the gears and the pump housing, and to the outlet.

2. The medical gear pump of claim 1, wherein said inlet, said cylindrical openings with said gears, and said outlet together define a pump body, and wherein the pump body is detachably joined to a drive body.

3. The medical gear pump of claim 2, wherein said pump body is adapted to be placed onto said drive body.

4. The medical gear pump of claim 3, wherein said pump body is joinable to said drive body via a bayonet coupling.

5. The medical gear pump of claim 4, wherein said pump body is configured as a solid plastic part in which said cylindrical openings are recessed whereby said gears are inserted into said cylindrical opening from one side of said pump body.

6. The medical gear pump of claim 5, wherein a coupling stem projects from said driven gear which stem is insertable into a corresponding coupling counterelement of a motor in said drive body.

7. The medical gear pump of claim 6, wherein an intermediate pin is arranged between said coupling stem of said driven gear and said motor.

8. The medical gear pump of claim 7, wherein said coupling between said coupling stem and said motor is configured as a slot coupling.

9. The medical gear pump of claim 1, wherein a stoppage sealing valve is arranged in said outlet.

10. The medical gear pump of claim 9, wherein said stoppage sealing valve is configured as a ball-type non-return valve.

11. The medical gear pump of claim 1, wherein said stoppage sealing valve is arranged in said outlet and said stoppage sealing valve is configured as a slit body made of a flexible material that is arranged in a cross section of said outlet.

12. The medical gear pump of claim 1, wherein a stoppage sealing valve is arranged in said outlet, wherein said stoppage sealing valve is configured as a magnetically driven plunger, connected in parallel with a motor of a drive mechanism, which can be extended in a blocking fashion into a cross section of said outlet when said motor switched off.

13. The medical gear pump of claim 1, wherein a pump body is provided which is detachably joined to said drive body, said inlet, said cylindrical openings with said gears and said outlet being arranged in said pump body, and, further comprising an overpressure valve for moving a cover relative to said pump housing and to said drive body during an overpressure situation in such a way that even though the drive mechanism is running, what occurs is not conveyance but rather return flow to said inlet.

14. The medical gear pump of claim 13, wherein said overpressure valve comprises an overpressure valve spring with plunger for slightly tilting said pump cover laterally away from said pump housing on one side during an overpressure situation.

15. The medical gear pump of claim 14, further comprising a pressure sensor disposed in said drive body, which pressure sensor communicates with said outlet via a membrane and a stub line.

16. The medical gear pump of claim 1, wherein said helical tooth of the gears is configured as a herringbone tooth set.

17. A medical gear pump for suction and irrigation comprising:

a pump housing having an inlet and an outlet and two cylindrical openings therebetween;

two meshing gears as conveying elements, one of which gears is joined to a drive mechanism, said gears being received in a non-journal-mounted fashion in the cylindrical openings of said pump housing, each of said gears comprising a plurality of helical teeth, each tooth having a tooth tip and a tooth root;

wherein the teeth of each of said gears mesh to define a helical tooth set which, when viewed along a surface line of said gears, defines at least two tooth tip/root contact points of said meshing gears, and wherein when a tooth of a first of said gears has completely penetrated into a tooth space of a second of said gears, its tooth tip substantially completely fills up said tooth space radially inside a pitch circle of the second of said gears;

wherein said pump housing and said gears define a path for liquid flow from the inlet, radially about the gears between the gears and the pump housing, and to the outlet; and wherein said inlet, said cylindrical openings with said gears, and said outlet together define a pump body, wherein the pump body is detachably joined to a drive body, and wherein said pump body is adapted to be placed onto said drive body.

18. The medical gear pump of claim 17, wherein said pump body is joinable to said drive body via a bayonet coupling.

19. The medical gear pump of claim 18, wherein said pump body is configured as a solid plastic part in which said cylindrical openings are recessed whereby said gears are inserted into said cylindrical openings from one side of said pump body.

20. The medical gear pump of claim 19, wherein a coupling stem projects from said driven gear which stem is insertable into a corresponding coupling counterelement of a motor in said drive body.

21. The medical gear pump of claim 20, wherein an intermediate pin is arranged between said coupling stem of said driven gear and said motor.

22. The medical gear pump of claim 20, wherein said coupling between said coupling stem and said motor is configured as a slot coupling.

23. The medical gear pump of claim 17, wherein a stoppage sealing valve is arranged in said outlet.

24. The medical gear pump of claim 23, wherein said stoppage sealing valve is configured as a ball-type non-return valve.

25. The medical gear pump of claim 17, wherein said stoppage sealing valve is arranged in said outlet and said stoppage sealing valve is configured as a slit body made of a flexible material that is arranged in a cross section of said outlet.

26. The medical gear pump of claim 17, wherein a stoppage sealing valve is arranged in said outlet, wherein said stoppage sealing valve is configured as a magnetically driven plunger, connected in parallel with a motor of a drive mechanism, which can be extended in a blocking fashion into a cross section of said outlet when said motor switched off.

27. The medical gear pump of claim 17, wherein a pump body is provided which is detachably joined to said drive body, said inlet, said cylindrical openings with said gears and said outlet being arranged in said pump body, and, further comprising an overpressure valve for moving a cover relative to said pump housing and to said drive body during an overpressure situation in such a way that even though the drive mechanism is running, what occurs is not conveyance but rather return flow to said inlet.

28. The medical gear pump of claim 27, wherein said overpressure valve comprises an overpressure valve spring with plunger for slightly tilting said pump cover laterally away from said pump housing on one side during an overpressure situation.

29. The medical gear pump of claim 28, further comprising a pressure sensor disposed in said drive body, which pressure sensor communicates with said outlet via a membrane and a stub line.

30. The medical gear pump of claim 17, wherein said helical tooth of the gears is configured as a herringbone tooth set.

* * * * *

UNITED STATES PATENT AND TRADEMARK OFFICE

CERTIFICATE OF CORRECTION

PATENT NO. : 6,361,082 B1
DATED : March 26, 2002
INVENTOR(S) : Hauki et al.

It is certified that error appears in the above-identified patent and that said Letters Patent is hereby corrected as shown below:

Title page,
Item [75], delete "Herrigardsflygeln", "Enebbavagen" and "Tradgardsgatan" and insert after "all of" -- Virsbo --.

Signed and Sealed this

Twenty-fourth Day of September, 2002

*Attest:*

*Attesting Officer*

JAMES E. ROGAN
*Director of the United States Patent and Trademark Office*